US012604958B1

(12) United States Patent
Chow

(10) Patent No.: US 12,604,958 B1
(45) Date of Patent: Apr. 21, 2026

(54) STORAGE BOX FOR HEADSET

(71) Applicant: BESAVIOR LIMITED, London (GB)

(72) Inventor: Charles Park Wah Chow, London (GB)

(73) Assignee: BESAVIOR LIMITED, London (GB)

( * ) Notice: Subject to any disclaimer, the term of this patent is extended or adjusted under 35 U.S.C. 154(b) by 0 days.

(21) Appl. No.: 19/305,973

(22) Filed: Aug. 21, 2025

(30) Foreign Application Priority Data

Jun. 12, 2025 (CN) ..... 202521206406.5

(51) Int. Cl.
*A45C 11/00* (2006.01)
*A45C 13/02* (2006.01)
*B65D 81/26* (2006.01)

(52) U.S. Cl.
CPC ..... *A45C 11/001* (2025.01); *A45C 13/02* (2013.01); *B65D 81/268* (2013.01)

(58) Field of Classification Search
None
See application file for complete search history.

(56) References Cited

U.S. PATENT DOCUMENTS

| | | | | |
|---|---|---|---|---|
| 9,422,094 | B2 * | 8/2016 | Niiro | B65D 5/5088 |
| 2021/0281942 | A1 | 9/2021 | Feng et al. | |
| 2021/0392426 | A1 | 12/2021 | You et al. | |
| 2022/0060809 | A1 | 2/2022 | Lin et al. | |
| 2022/0218083 | A1 * | 7/2022 | Wright | A45C 13/005 |
| 2023/0085536 | A1 | 3/2023 | Sun et al. | |

FOREIGN PATENT DOCUMENTS

| | | | |
|---|---|---|---|
| CN | 211224276 U | * | 8/2020 |
| CN | 211845295 U | * | 11/2020 |
| CN | 212086455 U | * | 12/2020 |
| CN | 213487407 U | * | 6/2021 |
| JP | 3234648 U | * | 10/2021 |

* cited by examiner

*Primary Examiner* — Bryon P Gehman

(57) ABSTRACT

A storage box for a headset includes a first housing, a second housing, and an accommodating space formed by the first housing and the second housing. The accommodating space includes: a first accommodating groove, disposed inside the storage box; a second accommodating groove, disposed at one side inside the storage box; and a third accommodating groove, disposed at the other side inside the storage box. A first drying package is disposed in the second accommodating groove near a left ear muff, and a second drying package is disposed in the third accommodating groove near a right ear muff.

18 Claims, 3 Drawing Sheets

STORAGE BOX FOR HEADSET

CROSS REFERENCE TO RELATED APPLICATIONS

This application claims priority benefits to Chinese Patent Application No. 2025212064065, filed on Jun. 12, 2025, the contents of which are incorporated herein by reference.

TECHNICAL FIELD

Embodiments of the present disclosure relate to the field of headset accessories, and in particular, to a storage box for a headset.

BACKGROUND

Headsets are widely used in daily life due to their excellent sound quality and comfortable wearing experience. However, due to a large volume and a complex structure, how to properly store a headset becomes a problem for a user. An existing storage box generally provides only a basic protection function, and cannot effectively solve a problem of internal component moisture caused by environmental humidity during a long-time storage process of a headset. In addition, some high-end headsets have an automatic sleep function to save power, but the existing storage boxes fail to make full use of this feature. Therefore, it is particularly important to design a storage box that can protect against moisture and trigger automatic sleep of the headset.

SUMMARY

The present invention aims to provide a storage box for a headset. The storage box not only provides effective protection for the headset, but also absorbs water vapor molecules in ear muffs through internally disposed drying packages, and triggers the headset to enter a sleep state through a magnetic sheet, thereby prolonging the service life of a battery and keeping headset performance stable.

Embodiments of the present disclosure provide a storage box for a headset, including a first housing and a second housing. The first housing is mated with the second housing to form an accommodating space for accommodating the headset. The accommodating space includes: a first accommodating groove, disposed inside the storage box, and configured to accommodate a head beam portion of the headset; a second accommodating groove, disposed at one side inside the storage box, and configured to accommodate a left ear muff portion of the headset; and a third accommodating groove, disposed at the other side inside the storage box, and configured to accommodate a right ear muff portion of the headset. A first drying package is disposed in the second accommodating groove, a second drying package is disposed in the third accommodating groove, and the first drying package and the second drying package are configured to absorb water vapor molecules carried in a left ear muff and a right ear muff of the headset.

In some implementations, a first bump is disposed in the second accommodating groove, a second bump is disposed in the third accommodating groove, and the first bump and the second bump are respectively adaptively nested outside or inside the left ear muff portion and the right ear muff portion, position and fix the left ear muff and the right ear muff.

In some implementations, the first bump is provided with a first placing groove, the second bump is provided with a second placing groove and the first drying package and the second drying package are respectively embedded in the first placing groove and the second placing groove.

In some implementations, the first bump and/or the second bump is further provided with taking grooves, and the first drying package and the second drying package are easily replaced through the taking grooves.

In some implementations, the taking grooves and the first placing groove or the second placing groove are communicated with each other.

In some implementations, the first accommodating groove is provided with an arc-shaped bump, and an outer wall shape of the arc-shaped bump is matched with an inner wall shape of the head beam portion, to fit and limit the head beam portion.

In some implementations, the arc-shaped bump is further internally provided with a storage groove, configured to store spare parts or a drying agent.

In some implementations, the second accommodating groove and the third accommodating groove are communicated with each other, so as to facilitate placement or removal of the left and right ear muff portions of the headset.

In some implementations, a headset sleep magnetic sheet is further disposed between the second accommodating groove and the third accommodating groove, and the headset sleep magnetic sheet is mated with a sensing module on the headset, to trigger the headset to enter a sleep state when the headset is placed in the storage box.

It can be learned from the analysis that the present invention provides a multi-functional storage box for a headset that integrates storage, moisture protection, limitation, and sleep control, which has good practicality, innovation, and promotion value, and is applicable to auxiliary use of various high-end wireless headsets. The disposed first drying package and second drying package can continuously absorb water vapor molecules caused by sweat or ambient humidity during wearing of the ear muffs, so as to prevent from going mouldy and producing odour inside the ear muffs, or prevent electronic components from being damaged by damp, thereby significantly prolonging the service life of the headset and improving the sanitary performance of the headset.

BRIEF DESCRIPTION OF THE DRAWINGS

Drawings of the specification, which form a part of the present disclosure, are used for providing further understanding of the present disclosure, and schematic embodiments and description thereof in the present disclosure are used for explaining the present disclosure and are not to be construed as an undue limitation of the present disclosure. In the drawings.

REFERENCE NUMERALS IN THE DRAWINGS

Figure 1:
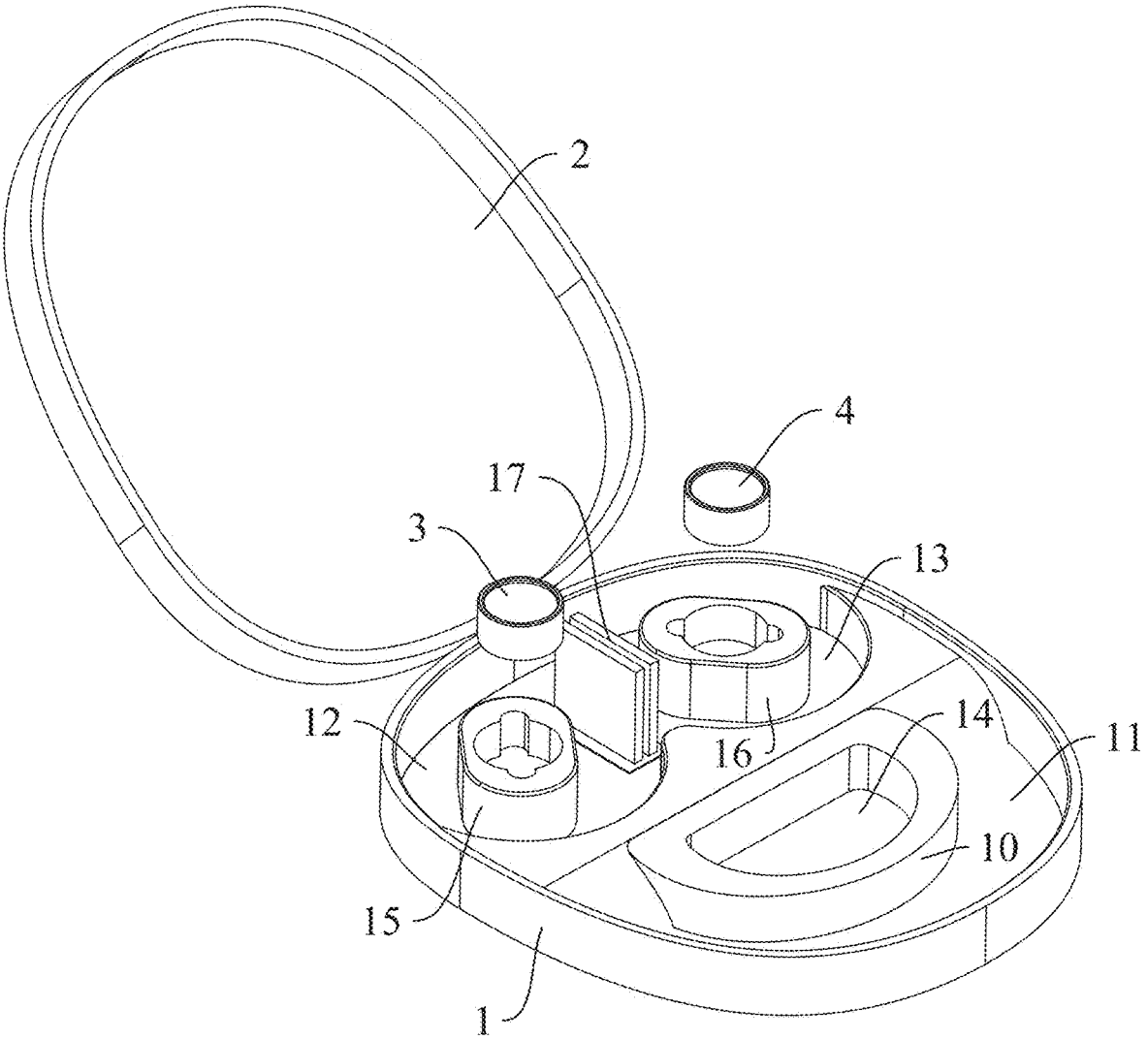
FIG. 1 is an exploded perspective view of a storage box for a headset according to an embodiment of the present disclosure.

1: first housing.
10: arc-shaped bump; 11: first accommodating groove; 12: second accommodating groove; and 13: third accommodating groove.
14: storage groove; 15: first bump; 16: second bump; and 17: headset sleep magnetic sheet.
151: first placing groove; 152: second placing groove; and 152*a*, 152*b*: taking groove.
2: second housing.
3: first drying package; and 4: second drying package.

DETAILED DESCRIPTION OF THE EMBODIMENTS

The present disclosure will be described in detail below with reference to the drawings in conjunction with the embodiments. Examples are provided by way of interpretation of the present disclosure and are not intended to limit the present disclosure. Actually, those skilled in the art will understand that modifications and variations may be made in the present disclosure without departing from the scope or spirit of the present disclosure. For example, features shown or described as part of an embodiment may be used in another embodiment to produce yet another embodiment. Therefore, it is expected that the present disclosure includes such modifications and variations that are incorporated into the scope of the appended claims and equivalents thereof.

In the description of the present disclosure, the indicative direction or position relations of the terms such as "longitudinal," "transverse," "upper," "lower," "front," "rear," "left," "right," "vertical," "horizontal," "top" and "bottom" are directional or positional relations illustrated based on the drawings, just for facilitating the description of the present disclosure, but not for requesting that the present disclosure must be constructed and operated in the specific direction, the terms cannot be understood as the restriction of the present disclosure. The terms "link," "connect" and "dispose" used in the present disclosure are to be understood broadly. For example, the components can be fixedly connected, or detachably connected. The components can be directly connected, or indirectly connected through an intermediate component. The components can be in wired connection or wireless connection, and can also be in wireless communication signal connection. The specific meanings of the above terms may be understood by those skilled in the art as appropriate.

The drawings illustrate one or more examples of the present disclosure. The detailed description uses numerals and alphanumeric symbols to refer to features in the drawings. Like or similar numbers in the drawings and descriptions have been used to refer to like or similar parts of the present disclosure. As used herein, terms such as "first," "second," and "third" may be used interchangeably to separate one component from another, and are not intended to represent the location or importance of a separate component.

Figure 2:
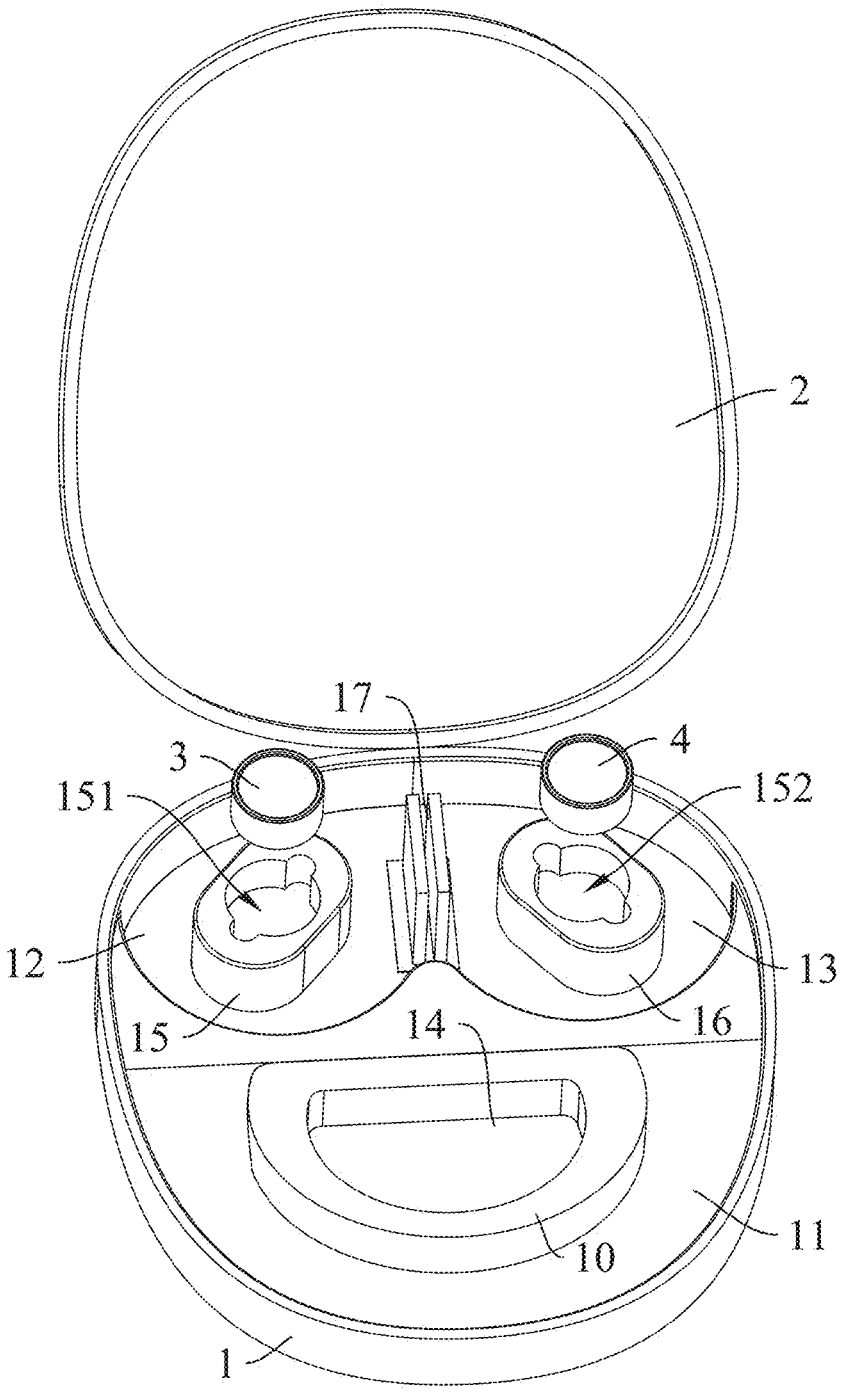
FIG. 2 is an exploded perspective view of a storage box for a headset according to an embodiment of the present disclosure from another perspective.
Figure 3:
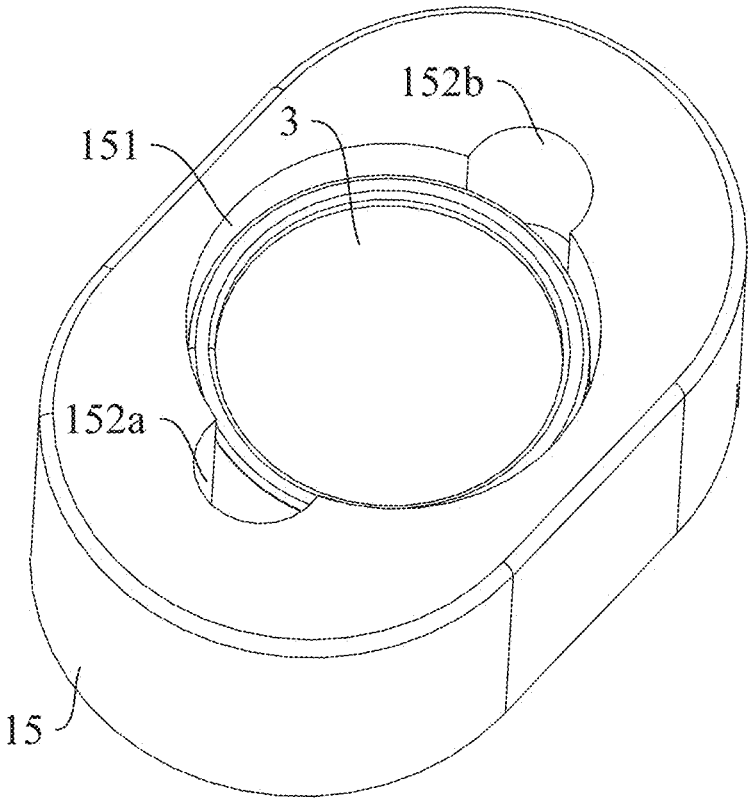
FIG. 3 is a perspective view of a first bump or a second bump, in which a drying package is placed, of a storage box for a headset according to an embodiment of the present disclosure.

As shown in FIG. 1 to FIG. 3, according to embodiments of the present disclosure, a storage box for a headset is provided. The storage box in the present disclosure includes a first housing 1 and a second housing 2. The first housing 1 and the second housing 2 may be rotatably connected, and may be connected in a covering manner. The first housing 1 is mated with the second housing 2 to internally form an accommodating space for accommodating the headset. The accommodating space includes a first accommodating groove 11, a second accommodating groove 12, and a third accommodating groove 13, which are respectively configured to accommodate a head beam portion, a left ear muff portion, and a right ear muff portion of the headset. In this structural design, partitioning storage of various components of the headset are implemented, so that mutual interference is avoided, and space utilization efficiency and using convenience of the storage box are improved. A first drying package 3 is disposed in the second accommodating groove 12 near the left ear muff, and a second drying package 4 is disposed in the third accommodating 13 near the right ear muff. The disposed first drying package and second drying package can continuously absorb water vapor molecules caused by sweat or ambient humidity during wearing of the ear muffs, so as to prevent from going mouldy and producing odour inside the ear muffs, or prevent electronic components from being damaged by damp, thereby significantly prolonging the service life of the headset and improving the sanitary performance of the headset.

In some embodiments, a first bump 15 is disposed in the second accommodating groove 12, and a second bump 16 is disposed in the third accommodating groove 13. These bumps are respectively adaptively nested outside or inside the left ear muff portion and the right ear muff portion, to accurately limit and stably fix the left and right ear muffs, and prevent the headset from being damaged due to displacement or collision during transportation or storage.

In some embodiments, as shown in FIG. 3, the first bump 15 is provide with a first placing groove 151, the second bump 16 is provide with a second placing groove 152, and the first drying package 3 and the second drying package 4 are respectively embedded in the first placing groove 151 and the second placing groove 152. This structure improves installation stability of the drying packages.

In some embodiments, the first bump 15 and/or the second bump 16 is further provide with taking grooves 152*a*, 152*b*, which facilitate a user in easily replacing the drying packages. This structure not only improves the installation stability of the drying packages, but also facilitates the user in replacing or maintaining the drying packages periodically through the design of the taking grooves, so as to ensure long-time effectiveness of a drying function.

In some embodiments, the first accommodating groove 11 is internally provided with an arc-shaped bump 10, and an outer wall shape of the arc-shaped bump 10 is matched with an inner wall shape of the head beam portion, so that the head beam portion can be tightly fitted when being placed into the storage box, avoiding shaking or sliding, and further enhancing the stability and safety of overall storage.

In some embodiments, as shown in FIG. 1 and FIG. 2, the arc-shaped bump 10 is internally provided with a storage groove 14, configured to store spare parts such as a USB cable, in-ear earphones, a drying agent and other small parts, to improve functional diversity of the storage box and meet the requirements of the user for multi-purpose storage.

In some embodiments, as shown in FIG. 1 and FIG. 2, a headset sleep magnetic sheet 17 is disposed between the second accommodating groove 12 and the third accommodating groove 13. When the headset is placed in the storage box, the magnetic sheet is mated with a sensing module on the headset to trigger the headset to enter a sleep state, thereby reducing unnecessary power consumption and improving user experience.

The foregoing descriptions are merely some embodiments of the present disclosure, but are not intended to limit the present disclosure. For those skilled in the art, the present disclosure can be of various modifications and changes. Any modification, equivalent replacement, or improvement made without departing from the spirit and principle of the present disclosure shall fall within the protection scope of the present disclosure.

What is claimed is:

1. A storage box for a headset, comprising a first housing and a second housing, the first housing being mated with the second housing to form an accommodating space for accommodating the headset, wherein:

the accommodating space comprises:

a first accommodating groove disposed inside the storage box and configured to accommodate a head beam portion of the headset;

a second accommodating groove disposed at one side inside the storage box and configured to accommodate a left ear muff portion of the headset; and a third accommodating groove disposed at another side inside the storage box and configured to accommodate a right ear muff portion of the headset, wherein a first drying package is disposed in the second accommodating groove, a second drying package is disposed in the third accommodating groove, and the first drying package and the second drying package are configured to absorb water vapor molecules carried in a left ear muff and a right ear muff of the headset;

wherein:

a first bump is disposed in the second accommodating groove, a second bump is disposed in the third accommodating groove, and the first bump and the second bump are respectively adaptively nested outside or inside the left ear muff portion and the right ear muff portion, to position and fix the left ear muff and the right ear muff.

2. The storage box for the headset according to claim 1, wherein:

the first bump is defined with a first placing groove, the second bump is defined with a second placing groove, and the first drying package and the second drying package are respectively embedded in the first placing groove and the second placing groove.

3. The storage box for the headset according to claim 2, wherein:

at least one of the first bump and the second bump is further provided with taking grooves respectively, and the first drying package and the second drying package are easily replaced through the taking grooves.

4. The storage box for the headset according to claim 3, wherein:

the taking grooves and the first placing groove or the second placing groove are communicated with each other.

5. The storage box for the headset according to claim 1, wherein:

the second accommodating groove and the third accommodating groove are communicated with each other, so as to facilitate placement or removal of the left and right ear muff portions of the headset.

6. A storage box for a headset, comprising a first housing and a second housing, the first housing being mated with the second housing to form an accommodating space for accommodating the headset, wherein:

the accommodating space comprises:

a first accommodating groove disposed inside the storage box and configured to accommodate a head beam portion of the headset;

a second accommodating groove disposed at one side inside the storage box and configured to accommodate a left ear muff portion of the headset; and a third accommodating groove disposed at another side inside the storage box and configured to accommodate a right ear muff portion of the headset, wherein:

the first accommodating groove is provided with an arc-shaped bump, and an outer wall shape of the arc-shaped bump is matched with an inner wall shape of the head beam portion, to fit and limit the head beam portion.

7. The storage box for the headset according to claim 6, wherein:

the arc-shaped bump is further internally defined with a storage groove configured to store spare parts or a drying agent.

8. The storage box for the headset according to claim 6, wherein:

a first bump is disposed in the second accommodating groove, a second bump is disposed in the third accommodating groove, and the first bump and the second bump are respectively adaptively nested outside or inside the left ear muff portion and the right ear muff portion, to position and fix the left ear muff and the right ear muff.

9. The storage box for the headset according to claim 8, wherein:

the first bump is defined with a first placing groove, and the second bump is defined with a second placing groove.

10. The storage box for the headset according to claim 9, wherein:

at least one of the first bump and the second bump is further provided with taking grooves respectively.

11. The storage box for the headset according to claim 10, wherein:

the taking grooves and the first placing groove or the second placing groove are communicated with each other.

12. The storage box for the headset according to claim 6, wherein:

the second accommodating groove and the third accommodating groove are communicated with each other, so as to facilitate placement or removal of the left and right ear muff portions of the headset.

13. A storage box for a headset, comprising a first housing and a second housing, the first housing being mated with the second housing to form an accommodating space for accommodating the headset, wherein:

the accommodating space comprises:

a first accommodating groove disposed inside the storage box and configured to accommodate a head beam portion of the headset;

a second accommodating groove disposed at one side inside the storage box and configured to accommodate a left ear muff portion of the headset; and a third accommodating groove disposed at another side inside the storage box and configured to accommodate a right ear muff portion of the headset, wherein:

a headset sleep magnetic sheet is further disposed between the second accommodating groove and the third accommodating groove, and the headset sleep magnetic sheet is mated with a sensing module on the headset, to trigger the headset to enter a sleep state when the headset is placed in the storage box.

14. The storage box for the headset according to claim 13, wherein:

a first bump is disposed in the second accommodating groove, a second bump is disposed in the third accommodating groove, and the first bump and the second bump are respectively adaptively nested outside or inside the left ear muff portion and the right ear muff portion, to position and fix the left ear muff and the right ear muff.

15. The storage box for the headset according to claim 14, wherein:

the first bump is defined with a first placing groove, and the second bump is defined with a second placing groove.

16. The storage box for the headset according to claim 15, wherein:

at least one of the first bump and the second bump is further provided with taking grooves respectively.

17. The storage box for the headset according to claim 16, wherein:

the taking grooves and the first placing groove or the second placing groove are communicated with each other.

18. The storage box for the headset according to claim 13, wherein:

the second accommodating groove and the third accommodating groove are communicated with each other, so as to facilitate placement or removal of the left and right ear muff portions of the headset.

* * * * *